US008439196B2

(12) United States Patent
Kemper et al.

(10) Patent No.: US 8,439,196 B2
(45) Date of Patent: May 14, 2013

(54) FOOD STORAGE CONTAINER SYSTEM

(75) Inventors: Bernard J. Kemper, Bonne Terre, MO (US); Charles H. Miller, Barnhart, MO (US); Janine Berger, Hoboken, NJ (US)

(73) Assignee: Handi-Craft Company, St. Louis, MO (US)

( * ) Notice: Subject to any disclaimer, the term of this patent is extended or adjusted under 35 U.S.C. 154(b) by 0 days.

(21) Appl. No.: 13/267,637

(22) Filed: Oct. 6, 2011

(65) Prior Publication Data

US 2012/0085677 A1 Apr. 12, 2012

Related U.S. Application Data

(60) Provisional application No. 61/391,329, filed on Oct. 8, 2010.

(51) Int. Cl.
*B65D 75/00* (2006.01)
*B65D 21/02* (2006.01)

(52) U.S. Cl.
USPC ..... 206/430; 206/508; 220/23.6

(58) Field of Classification Search ..... 206/139, 206/140, 203, 427, 545, 430, 503, 505, 508, 206/515; 220/23.4, 23.6, 796–798, 801–807; 426/108, 115, 120
See application file for complete search history.

(56) References Cited

U.S. PATENT DOCUMENTS

| | | | | |
|---|---|---|---|---|
| D194,985 | S * | 4/1963 | Rifkind et al. | 206/203 |
| 4,040,539 | A * | 8/1977 | Patterson | 426/115 |
| 4,177,933 | A * | 12/1979 | Lumpp | 220/801 |
| RE30,962 | E * | 6/1982 | Bridges | 220/23.6 |
| 5,016,756 | A * | 5/1991 | Wischhusen et al. | 206/545 |
| 5,116,240 | A * | 5/1992 | Wischhusen et al. | 206/545 |
| 6,296,120 | B1 * | 10/2001 | Danko | 206/564 |
| 6,883,678 | B2 * | 4/2005 | Chou | 220/798 |
| 7,124,891 | B2 * | 10/2006 | Kolar et al. | 206/515 |
| 7,392,907 | B2 * | 7/2008 | Herbert et al. | 206/515 |
| 2005/0241977 | A1 | 11/2005 | Herbert et al. | |
| 2009/0090714 | A1 * | 4/2009 | Albers et al. | 220/262 |

FOREIGN PATENT DOCUMENTS

GB 1331742 A 9/1973

OTHER PUBLICATIONS

International Search Report and Written Opinion issued in PCT Application No. PCT/US2011/055395, mailed Feb. 24, 2012, 13 pages.

http://thelittlestarhouse.wordpress.com/2009/10/28/most-popular-searches/704pk_baby_cubes/; "Welcome to the Little Star House"; Sep. 10, 2010; 2 pages.

* cited by examiner

*Primary Examiner* — Bryon Gehman

(74) *Attorney, Agent, or Firm* — Armstrong Teasdale LLP

(57) ABSTRACT

A food storage container system including a plurality of food containers and a tray is provided. Each food container includes a container body defining an interior space for holding a product therein and a lid configured to open and close the interior space. The container body is formed from a material including a silicone elastomer. The tray includes a plurality of holders. Each holder defines a recess sized and shaped to removably hold one container of the plurality of containers therein.

20 Claims, 10 Drawing Sheets

SECTION A-A

FOOD STORAGE CONTAINER SYSTEM

CROSS REFERENCE TO RELATED APPLICATIONS

This application claims the benefit of U.S. Provisional Application No. 61/391,329 filed Oct. 8, 2010, which is hereby incorporated by reference in its entirety.

FIELD

The present disclosure relates generally to a food storage container system.

BACKGROUND

Food storage containers may be used to store food, such as baby food, in a refrigerator or freezer for an extended period of time. Upon removing the food container from the refrigerator or freezer, it may be advantageous to immediately place the container of food into a microwave to heat the food. Thus, it is advantageous if the food storage container is both freezer-safe and microwave-safe.

SUMMARY

In one aspect, a food storage container system including a plurality of food containers and a tray is provided. Each food container includes a container body defining an interior space for holding a product therein and a lid configured to open and close the interior space. The container body is formed from a material including a silicone elastomer. The tray includes a plurality of holders. Each holder defines a recess sized and shaped to removably hold one container of the plurality of containers therein.

In another aspect, a food container configured to be supported within a tray is provided. The food container includes a container body defining an interior space for holding a product therein and a lid configured to open and close the interior space. The container body is formed from a material including a silicone elastomer and is configured to be positioned within a holder of the tray.

BRIEF DESCRIPTION OF THE DRAWINGS

Corresponding reference characters indicate corresponding parts throughout the drawings.

DETAILED DESCRIPTION OF THE INVENTION

In one aspect, a food storage container system generally includes a plurality of food containers and a tray. Each container includes a container body defining an interior space for holding food therein, and a lid configured to open and close the interior space. The container body may be formed from a material including a silicone elastomer. The tray includes a plurality of holders. Each holder defines a recess sized and shaped to removably hold one of the plurality of containers therein.

Referring to FIGS. 1-7, one embodiment of a food storage container system is generally indicated at 10. The illustrated food storage container system 10 includes a plurality of individual food containers (e.g., six), each of which is generally indicated at 12, and a tray, generally indicated at 14, having a plurality of holders 16 (e.g., six) sized and shaped to individually and removably receive and hold the food containers therein. It is understood that the food storage container system 10 may include more than six or less than six food containers 12 without departing from the scope of the present invention. The food containers 12 are substantially identical in size and shape, and the holders 16 are likewise substantially identical in size and shaped such that any one of the containers is receivable in any one of the holders. It is understood that in other embodiments some or all of the containers 12 may be of different sizes and/or shapes, and that all or some of the holders 16 may be sized and shaped to receive only selected ones of the containers. As explained in more detail below, the only substantial difference between the illustrated containers 12 is the color of a colored band 20 (broadly, a colored portion) of the container.

Figure 8A:
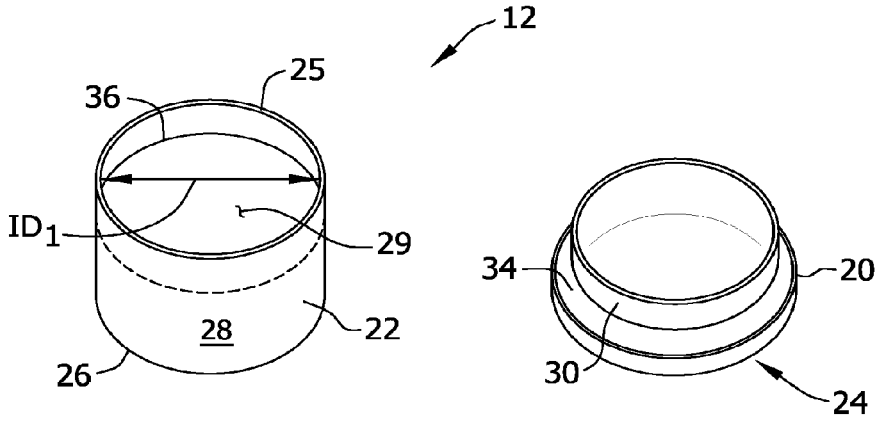
FIG. 8A is a top perspective of one of the containers of FIG. 1 with a lid removed from a body of the container.
Figure 8B:
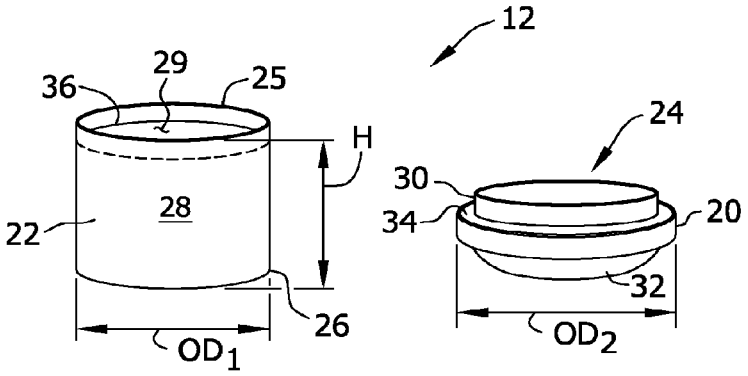
FIG. 8B is a front elevation of the container of FIG. 8A.
Figure 8C:
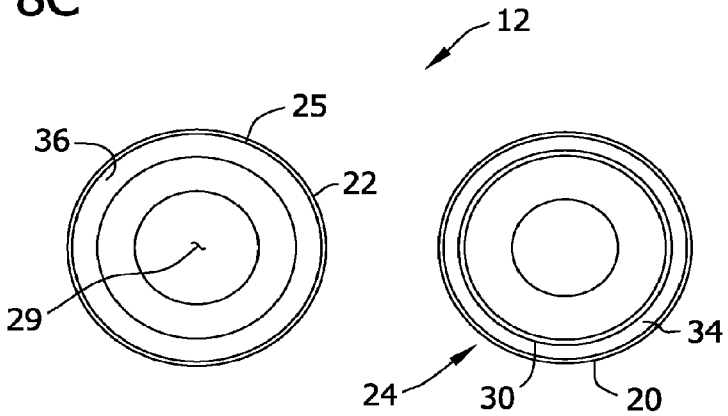
FIG. 8C is a top plan of the container of FIG. 8A.

For purposes of the following disclosure, only one of the containers 12 will be described in detail with the understanding that the other containers have a substantially similar structure, other than the color of the colored band 20. Referring to FIGS. 8A-8C, the container 12 includes a body 22 and a lid, generally indicated at 24. The container body 22 has an open top 25, a closed bottom or base 26, and a sidewall 28 extending between the open top 25 and the closed base 26. The illustrated container body 22 has a generally cylindrical shape, although it may have other shapes without departing from the scope of the present invention. Moreover, the base 26 has a planar outer surface so that the container body 22 sits upright and does not fall over when placed on a planar surface.

Interior surfaces of the sidewall 28 and the base 26 together define an interior space 29 for receiving and storing a product, such as food, in the container 12. In one non-limiting example, the container body 22 may have a height H measuring from about 1 in (2.54 cm) to about 7 in (17.78 cm), an outer cross-sectional dimension $OD_1$ (e.g., outer diameter) measuring from 1 in (2.54 cm) to about 7 in (17.78 cm), and an inner cross-sectional dimension $ID_1$ (e.g., inner diameter). The sidewall 28 may have a thickness measuring from about 0.010 in (0.0254 cm) to about 0.50 in (1.27 cm), and the interior space 29 may have a volume measuring from about 1 $in^3$ (16.39 $cm^3$) to about 270 $in^3$ (4.4×103 $cm^3$). Depending on the material used to construct the container body 22, a suitable thickness of the sidewall 28 may be selected to provide resilient flexibility of the container body 22. The container body 22 may have other suitable dimensions without departing from the scope of the present invention.

The container body 22, or at least a portion thereof, may be generally transparent to allow for identification of the type of food in the container 12 without removing the lid 24, or the container body 22 may be substantially opaque. The container body 22 may be formed from any suitable material that is FDA-compliant as a food-grade material for repeated use as a food contact product. For example, the container body 22 may be made from an FDA-compliant silicone elastomer material. The silicone elastomer may be microwave-safe and freezer-safe to allow a user to store frozen food in the containers 12 (i.e., store containers of food in a freezer) and heat the food while still in the container 12. Moreover, silicone elastomers do not conduct heat like metals, allowing a user to touch the silicone container body 22 shortly after removing it from a microwave. In addition, the silicone elastomer material can provide a relatively high level of ease in removing food from the container body 22. For example, in addition to the inherent surface properties of silicone elastomer material, the capability of silicone elastomer material to resiliently bend and resiliently flex can assist in the release of food from the container body 22. Because a suitable silicone elastomer may have substantially consistent properties, including relatively high strength and resilient flexibility, over a wide temperature range (e.g., −50 to 300 degrees C.), the silicone container body 22 remains substantially resiliently flexible even when stored in the freezer and when the food inside the container is frozen. Thus, the silicone container body 22 may facilitate easy removal of frozen food from the container 12.

In another example, the container body 22 may be made from an FDA-compliant thermoplastic material.

The lid 24 is removably attachable over the open top 25 of the container body 22 for closing the interior space 29 to retain food therein and for opening the interior space 29 to allow access to the food therein. In the illustrated embodiment, the lid 24 is completely removable from the container body 22. Thus, because the container body 22 and the lid 24 of each container 12 are substantially identical structurally to the other lids and container bodies, any lid 24 is removably attachable to any container body 22, and vice versa. However, it is understood that the lid 24 may be secured to the container body 22, such as by a hinge or tether, without departing from the scope of the present invention.

The lid 24 has a lower portion 30, an upper portion 32 (e.g., dome-shaped upper portion), and an annular flange 34 intermediate the lower and upper portions. The lower portion 30 of the lid 24 is removably insertable into the open top 25 of the container body 22 and is configured to form an interference or friction fit with the interior surface of the container sidewall 28 adjacent the open top 25 to allow for selective closing and opening of the interior space 29. In one embodiment, at least the lower portion 30 of the lid 24 is generally rigid, which facilitates easy insertion of the lid 24 into the resiliently flexible container body 22. In the illustrated embodiment, substantially the entire lid 24 is generally rigid, although it is understood that portions of the lid 24 may be resiliently flexible, or the entire lid 24, including the lower portion 30, may be resiliently flexible.

The interior surface of the sidewall 28 may include an annular groove 36 in which the lower portion 30 of the lid 24 is receivable. The annular flange 34 has an outer cross-sectional dimension $OD_2$ (e.g., an outer diameter) that is greater than the inner cross-sectional dimension $ID_1$ at the open top 25 of the container body 22 so that the flange 34 contacts the top 25 to act as a depth stop for the lid 24. It is also understood that the lid 24 may be removably attachable over the open top 25 of the container body 22 to selectively open and close the interior space 29 in other ways without departing from the scope of the present invention.

The lid 24 may be substantially opaque or may be generally transparent. The lid 24 may be formed from any suitable material that is FDA-compliant as a food-grade material for repeated use as a food contact product. The lid may be freezer-safe and/or microwave-safe. In one non-limiting example, the lid 24 may be formed (e.g., molded) from a polypropylene containing material, or from other suitable material.

As set forth above herein, each of the food containers 12 includes the colored band 20 (broadly, a colored portion of the container) having a selected color that is different from each band on the other containers 12 in the food storage container system 10. It is understood that one or more groups of the containers 12 may include colored bands 20 having the same color. In the illustrated embodiment, the colored bands 20 are on respective container lids 24. More specifically, each of the colored bands 20 extends around a peripheral surface of the annular flange 34 of the corresponding lid 24. The colored bands 20 may be formed on other portions of the containers 12 without departing from the scope of the present invention. Moreover, it is contemplated that the lid 24 and the container body 22 of each container 12 may include matching colored portions. The colors of the colored bands 20 in the illustrated embodiment are readily distinguishable from one another, and may include such colors as blue, red, yellow, purple, orange, and green. It is understood that the containers 12 may omit the differently colored bands or differently colored portions without departing from the scope of the present invention.

The colored bands 20 may be formed in any suitable way. Colored ink or dye, for example, may be applied directly to the outer periphery of the annular flanges 34. In another non-limiting example, the colored bands 20 may be formed as separate structures that are secured to the annular flanges 34. Other ways of forming the colored bands 20 do not depart from the scope of the present invention.

Referring to FIGS. 1-7 and as set forth above herein, the tray 14 includes a plurality of the holders 16. In the illustrated tray 14, the holders 16 are substantially individually defined, spaced apart from one another, and arranged in two rows, with three holders being in each row. It is understood that the holders 16 may be arranged differently than in the illustrated tray 14, and/or the tray may include more than six holders or less than six holders without departing from the scope of the present invention. Each holder 16 has a sidewall 40, defining the sides of the tray 14, and a bottom 42 (FIGS. 6 and 7), defining the bottom of the tray 14, that is at least partially closed. The sidewall 40 and the bottom 42 of each holder 16 are separate and distinct from the respective sidewall and bottom of the other holders 16. In the illustrated embodiment, ribs 44 connect sidewalls 40 of adjacent holders 16. As can be seen best in FIGS. 1-2 and 6-7, the holders 16 have the appearance of being separate, individual components when viewing the sides and the bottom of the tray 14.

Figure 1:
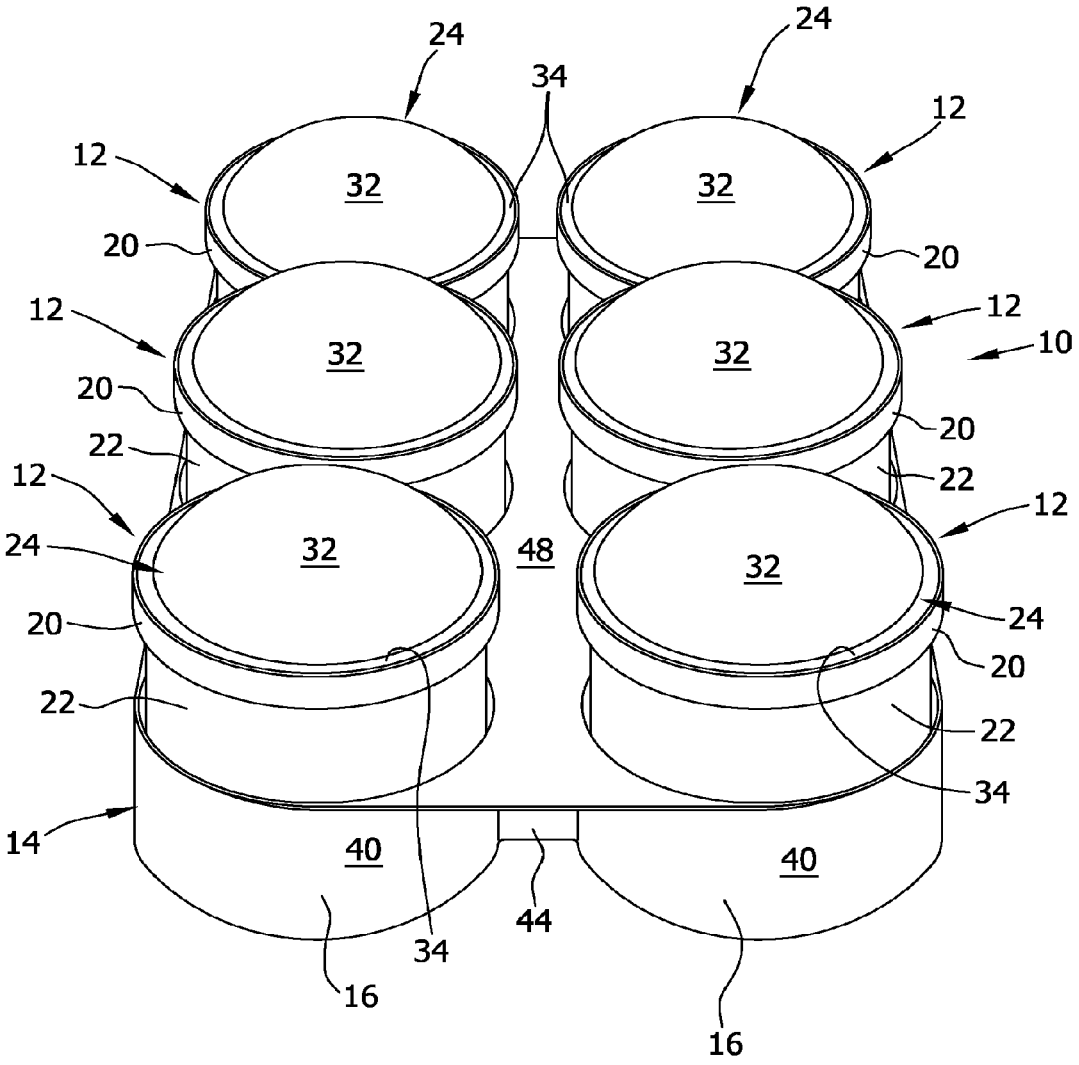
FIG. 1 is a front perspective of a food storage container system according to one embodiment of the present invention, the food storage container system including a plurality of food storage containers and a tray for holding the storage containers.
Figure 2:
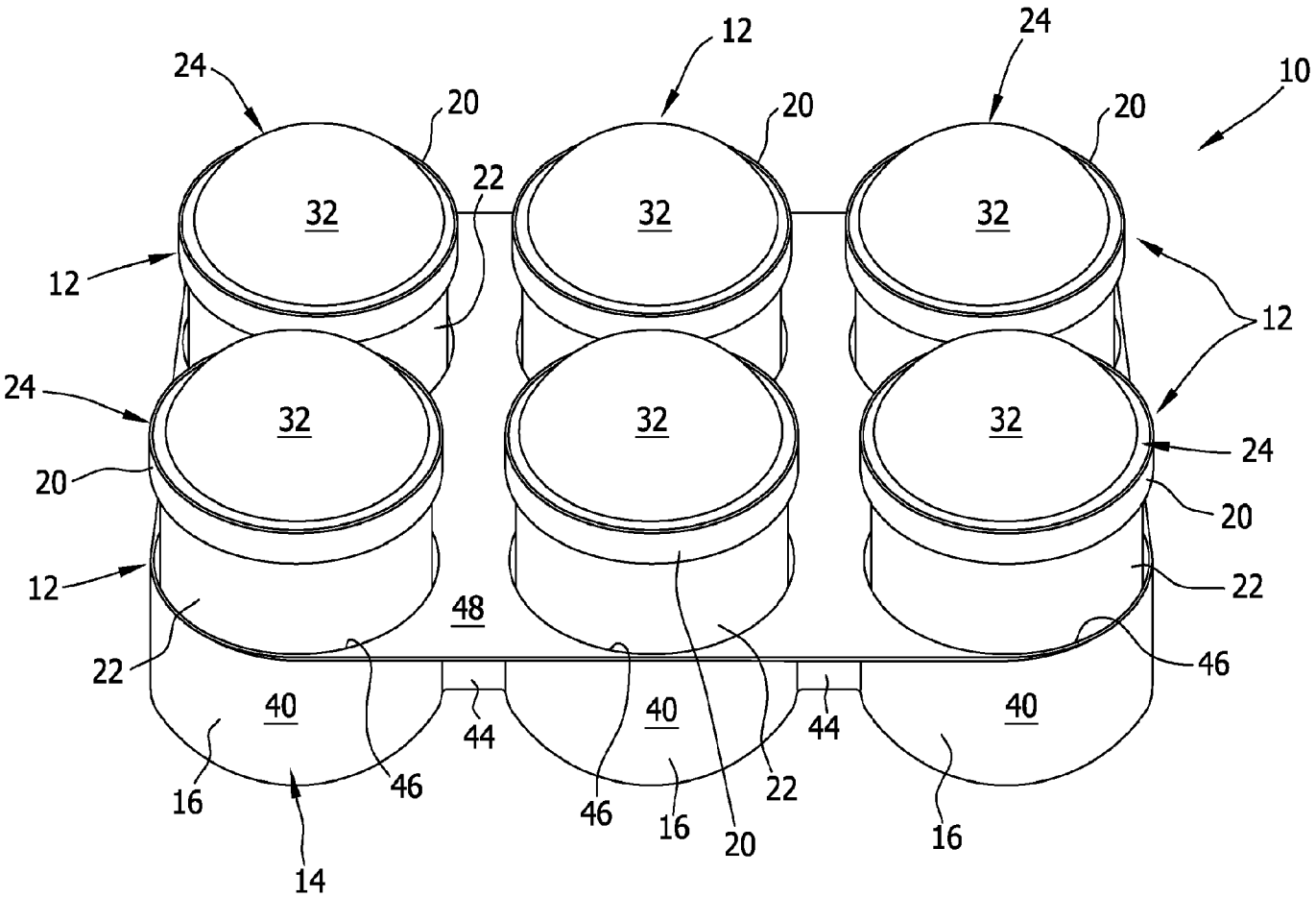
FIG. 2 is a side perspective of the food storage container system of FIG. 1.
Figure 3:
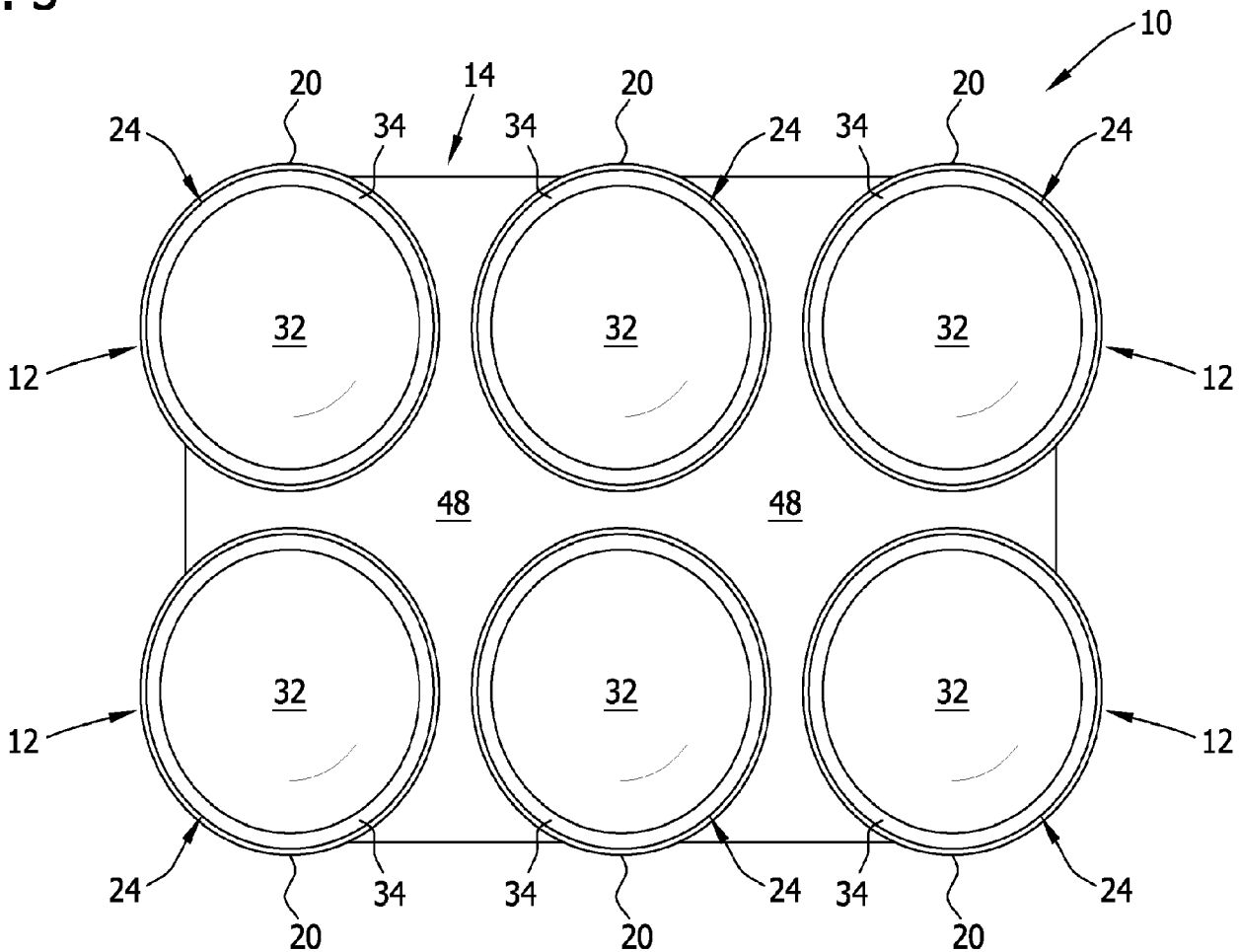
FIG. 3 is a top plan of the food storage container system of FIG. 1.
Figure 4:
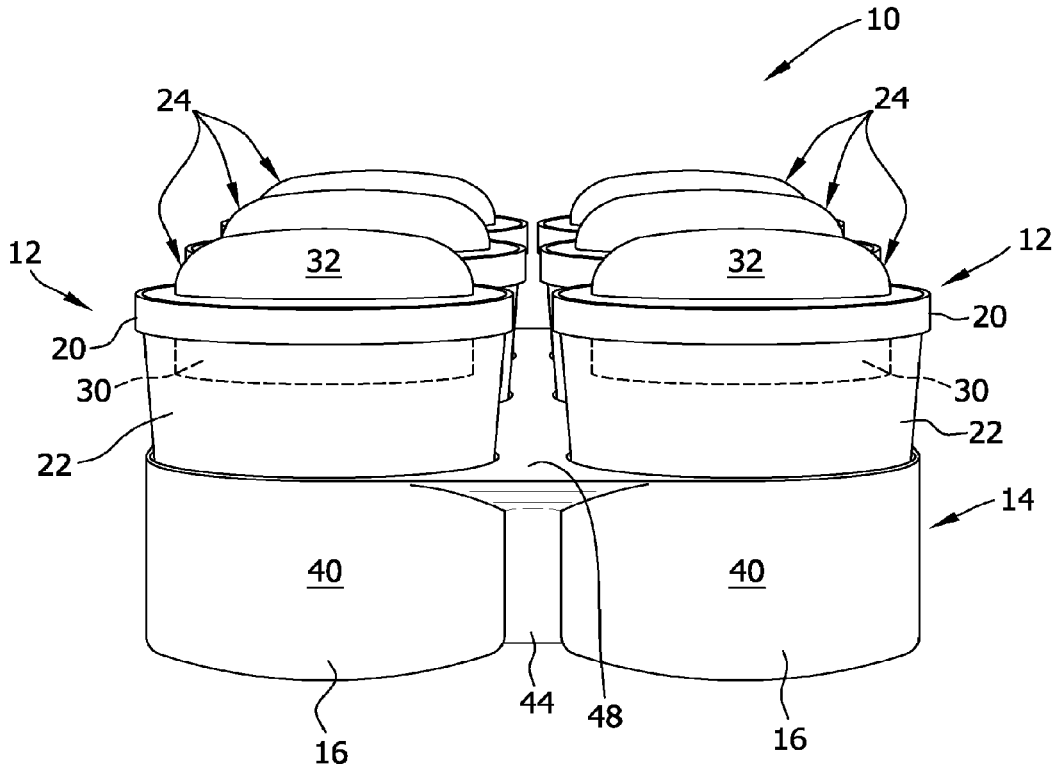
FIG. 4 is a front elevation of the food storage container system of FIG. 1.
Figure 5:
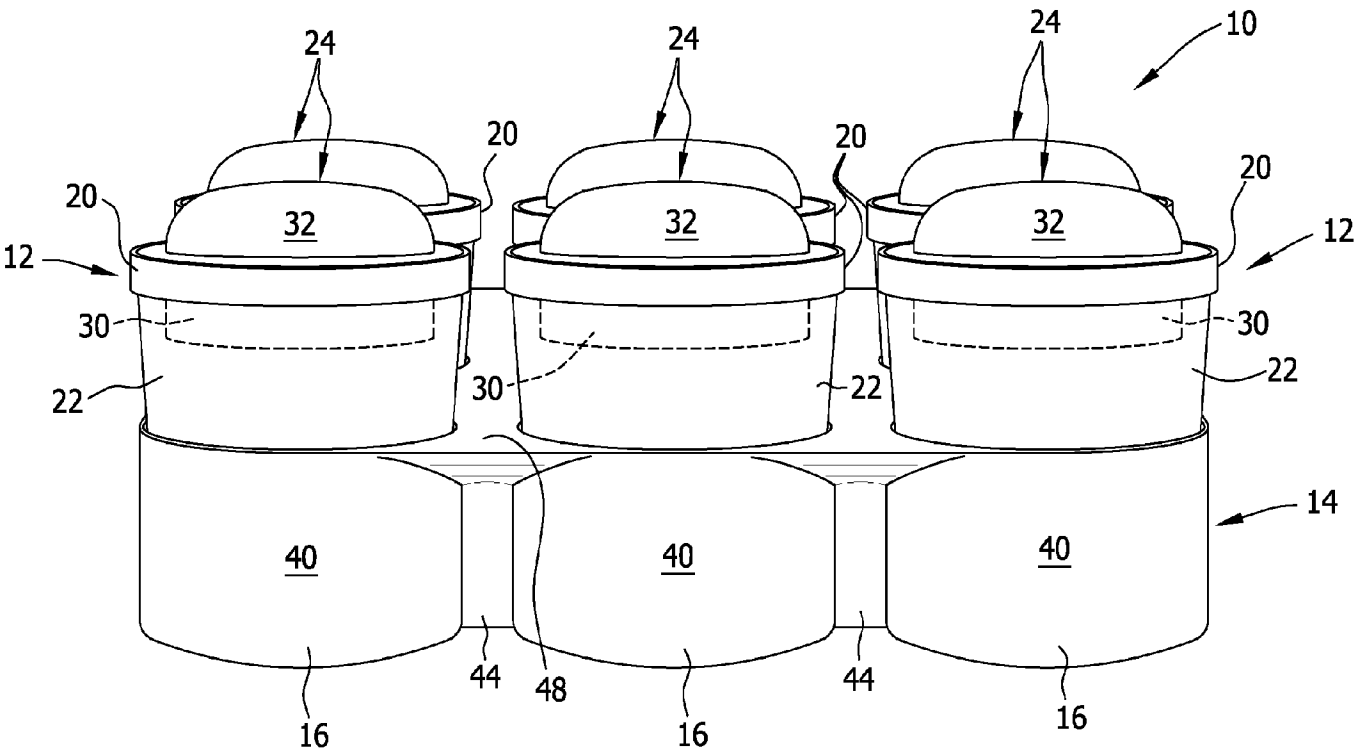
FIG. 5 is a side elevation of the food storage container system of FIG. 1.
Figure 6:
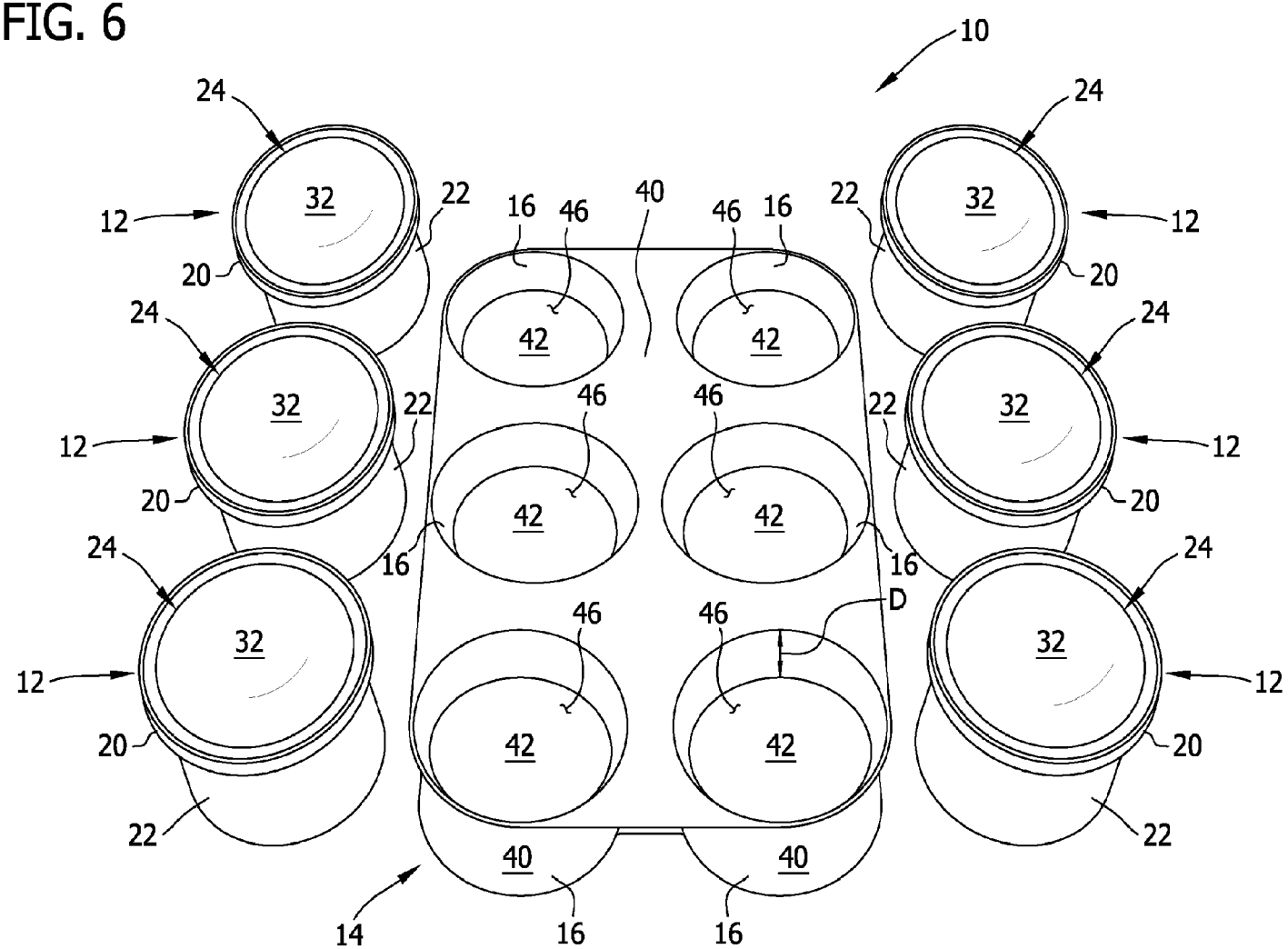
FIG. 6 is a front perspective of the food storage container system of FIG. 1 with the food storage containers removed from the tray.

As seen best in FIG. 6, each holder 16 defines a recess 46 extending from a generally planar upper surface 48 of the tray 14 to the closed bottom 42 of the holder. The planar upper surface 48 of the tray 14 extends between the holders 16 giving the appearance that the holders are not separate, individual components when viewing the top of the tray. Each recess 46 is sized and shaped to receive and hold one of the containers 12 therein. As can be seen in FIGS. 1-2 and 4-5, a depth D of each recess 46 (FIG. 6) may be less than the height H of each container body 22 such that a portion of each container body 22 extends out of the corresponding holder 16 and above the upper surface 48 of the tray 14. Thus, where the sidewall 28 of the container body 22 is generally transparent, the user can readily identify the type of food present in each of the containers 12 without removing the containers 12 from the tray 14 and without removing the lids 24. In one example, the depth D of each holder 16 is between about 10% and about 50% of the height H of each container body 22, and more specifically, between about 25% and about 40% of the height H of each container body 22. The depth D of each holder 16 relative to the height H of each container body 22 may be other than disclosed herein.

Figure 7:
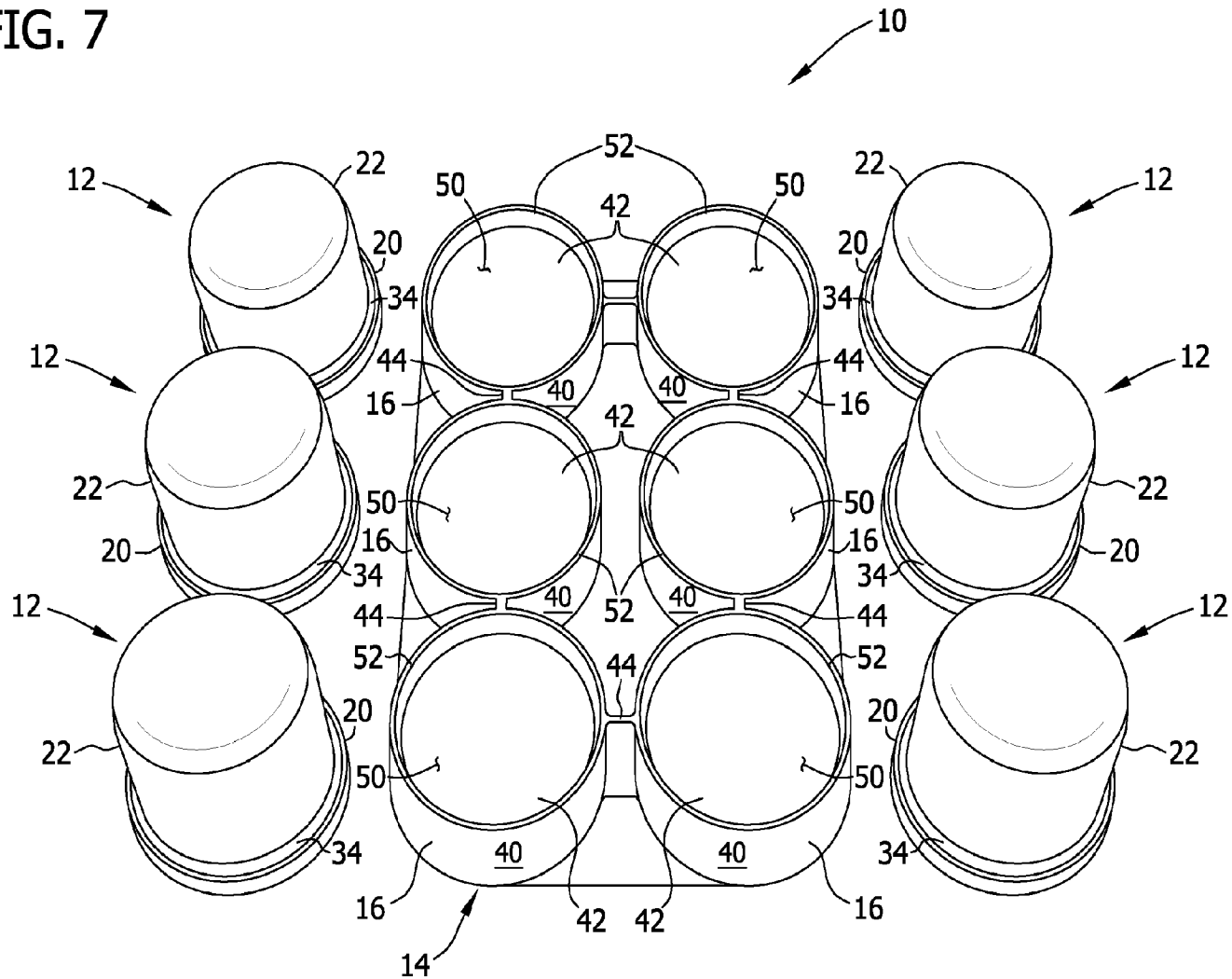
FIG. 7 is a bottom perspective of the food storage container system of FIG. 1 with the food storage containers removed from the tray.
Figure 9:
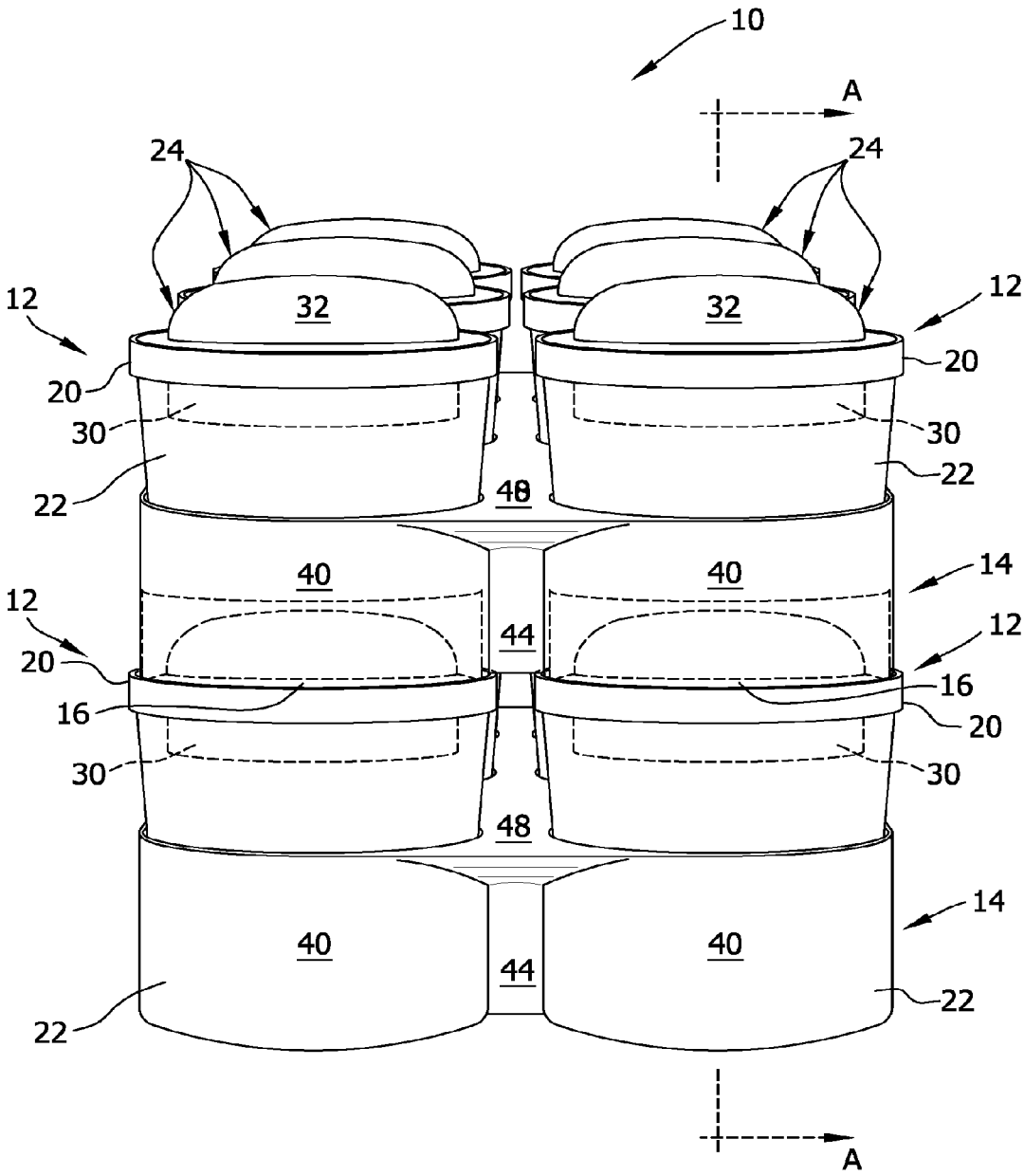
FIG. 9 is a front elevation of the food storage container system of FIG. 1 stacked on an identical food storage container system.
Figure 10:
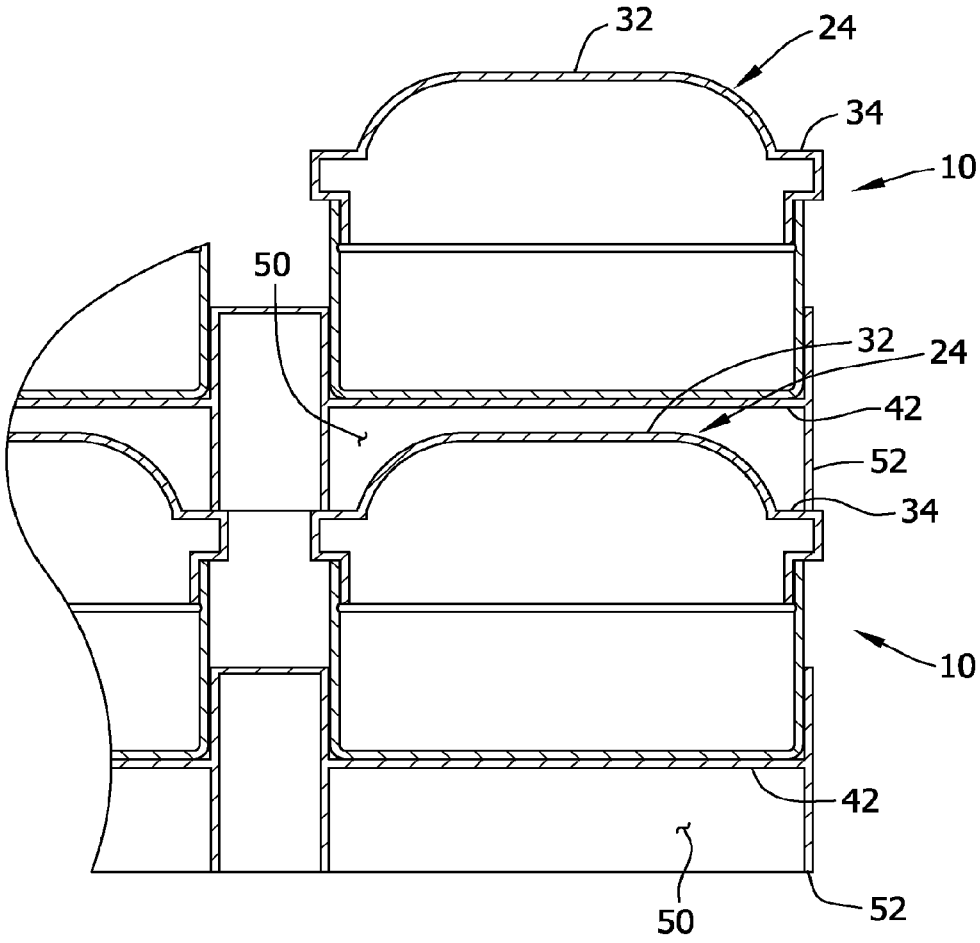
FIG. 10 is a partial section view of FIG. 9.

Referring to FIGS. 7, 9, and 10, the bottom 42 of each holder 16 defines a recess 50 that is sized and shaped to receive the upper portion 32 of the lid 24 of one of the containers 12 so that multiple food storage container systems are stackable. An annular rim 52 at the bottom 42 of each holder partially defines the corresponding recess 50. When the tray 14 of one food storage container system 10 is stacked on containers 12 of an identical food storage container system, the annular rims 52 rest on upper surfaces of the annular flanges 34, such that the flanges act as depth stops for the upper portions 32 of the lids 24. The rim 52 may be other shapes without departing from the scope of the present invention. The food storage container system 10 may not be stackable without departing from the scope of the present invention.

The tray 14 may be formed from any suitable material. The tray 14 may be freezer-safe and/or microwave-safe. In one non-limiting example, the tray 14 may be formed from polypropylene. The tray 14 may be molded or formed in other ways.

When introducing elements of the present invention or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A food storage container system comprising:

a plurality of food containers each comprising:

a container body defining an interior space for holding a product therein, the container body being formed from a material including a silicone elastomer, the container body comprising:

an open top, a base, and a sidewall extending between the open top and the base; and an annular groove defined in an inner surface of the sidewall adjacent the open top; and a lid configured to open and close the interior space, the lid comprising a lower portion, an upper portion, and an annular flange positioned intermediate the lower portion and the upper portion, wherein the annular flange is configured to contact the open top of the container body to act as a depth stop for the lid; and a tray comprising a plurality of holders, each holder defining a top recess sized and shaped to removably hold a respective one of the plurality of containers therein, each holder comprising a lower annular rim defining a bottom recess configured to receive a portion of the lid of one of the plurality of containers, wherein the annular rim is configured to rest on an upper surface of the annular flange of said lid of one of the plurality of containers.

2. A food storage container system in accordance with claim 1, wherein the lid is formed from a material including polypropylene.

3. A food storage container system in accordance with claim 1, wherein the lid is configured to friction fit within the open top of the container body.

4. A food storage container system in accordance with claim 1, wherein the lower portion of the lid is configured to friction fit within the open top of the container body.

5. A food storage container system in accordance with claim 1, wherein a height of the container body is larger than a depth of the holders of the tray.

6. A food storage container system in accordance with claim 5, wherein the depth of the holders is between about 10% and about 50% of the height of the container body.

7. A food storage container system in accordance with claim 1, wherein each holder of the tray comprises a sidewall and a bottom defining the top recess.

8. A food storage container system in accordance with claim 7, wherein the tray further comprises ribs connecting sidewalls of adjacent holders of the plurality of holders.

9. A food storage container system in accordance with claim 7, wherein the tray further comprises an upper surface extending between the holders of the plurality of holders.

10. A food storage container system in accordance with claim 1, wherein the annular flange of the lid of each of the containers includes a colored band.

11. A food container configured to be supported within a tray, the food container comprising:

a container body defining an interior space for holding a product therein, the container body is formed from a material including a silicone elastomer, wherein the body is configured to be positioned within a holder of the tray, the container body comprising:

an open top, a base, and a sidewall extending between the open top and the base; and an annular groove defined in an inner surface of the sidewall adjacent the open top; and a lid configured to open and close the interior space, the lid comprising a lower portion, an upper portion, and an annular flange positioned intermediate the lower portion and the upper portion, wherein the lower portion is configured to friction fit within an open top of the container, and wherein the annular flange is configured to contact the open top of the container body to act as a depth stop for the lid.

12. A food container in accordance with claim 11, wherein the lid is formed from a material including polypropylene.

13. A food container in accordance with claim 11, wherein a height of the container body is larger than a depth of the holder of the tray.

14. A food container in accordance with claim 11, wherein the annular flange of the lid includes a colored band.

15. A food container in accordance with claim 11, wherein the container body is generally transparent and the lid is substantially opaque.

16. A food storage container system comprising:

a plurality of food containers, each of the food containers comprising:

a container body defining an interior space for holding a product therein, the container body being formed from a material including a silicone elastomer; and a lid configured to open and close the interior space, the lid comprising a lower portion, an upper portion, and an annular flange positioned intermediate the lower portion and the upper portion, wherein the lower portion is configured to friction fit within an open top of the container; and a tray comprising a plurality of holders, each holder defining a top recess sized and shaped to removably hold a respective one of the plurality of containers therein, each holder comprising a lower annular rim defining a bottom recess configured to receive a portion of the lid of one of the plurality of containers, wherein the annular rim is configured to rest on an upper surface of the annular flange of said lid of one of the plurality of containers.

17. A food storage container system in accordance with claim 16, wherein the annular flange of the lid of each of the containers includes a colored band.

18. A food storage container system in accordance with claim 16, wherein the container body of each of the containers is generally transparent and the lid of each of the containers is substantially opaque.

19. A food storage container system in accordance with claim 16, wherein the lid is formed from a material including polypropylene.

20. A food storage container system in accordance with claim 16, wherein a height of the container body is larger than a depth of the holders of the tray.

* * * * *